US009945580B2

(12) United States Patent
Penlesky et al.

(10) Patent No.: US 9,945,580 B2
(45) Date of Patent: Apr. 17, 2018

(54) VENTILATION SYSTEM

(75) Inventors: Robert G. Penlesky, Waukesha, WI (US); Daniel L. Karst, Beaver Dam, WI (US); Mirko Zakula, New Berlin, WI (US); John R. Adrian, Oshkosh, WI (US)

(73) Assignee: Broan-NuTone, LLC, Hartford, WI (US)

( * ) Notice: Subject to any disclaimer, the term of this patent is extended or adjusted under 35 U.S.C. 154(b) by 844 days.

(21) Appl. No.: 13/597,123

(22) Filed: Aug. 28, 2012

(65) Prior Publication Data

US 2014/0065940 A1 Mar. 6, 2014

(51) Int. Cl.

| | |
|---|---|
| ***F24F 7/007*** | (2006.01) |
| ***F24F 13/32*** | (2006.01) |
| ***F24F 7/06*** | (2006.01) |
| ***F04D 25/14*** | (2006.01) |
| ***F04D 29/42*** | (2006.01) |
| ***F04D 29/60*** | (2006.01) |

(52) U.S. Cl.

CPC ..... *F24F 13/32* (2013.01); *F04D 25/14* (2013.01); *F04D 29/4226* (2013.01); *F04D 29/601* (2013.01); *F24F 7/06* (2013.01)

(58) Field of Classification Search

CPC ..... F24F 13/32; F16B 5/06

USPC ..... 454/230

See application file for complete search history.

(56) References Cited

U.S. PATENT DOCUMENTS 2,913,810 A * 11/1959 Heim ..... F16C 11/0614 29/898.063
2,923,225 A * 2/1960 Massey ..... 454/363
4,919,379 A * 4/1990 Goetz ..... A45B 11/00 24/521

(Continued)

FOREIGN PATENT DOCUMENTS

CN 104736936 A 6/2015
HK 1208063 A1 2/2016

(Continued)

OTHER PUBLICATIONS

Asada, JP 05-256489 A English machine translation, Oct. 5, 1993.*

(Continued)

*Primary Examiner* — Alissa Tompkins
*Assistant Examiner* — Phillip E Decker
(74) *Attorney, Agent, or Firm* — McDermott Will & Emery LLP

(57) ABSTRACT

Embodiments of the invention provide a ventilation assembly comprising a main housing adapted for installation into standard 2'×4' wall or ceiling construction within a building or space. The main housing can include a fluid inlet through which fluid is received within the main housing, and a fluid outlet through which fluid exits the main housing. The ventilation assembly can be installed in place of an existing ventilation exhaust fan assembly, or can be installed in a space where no ventilation assembly has previously existed. The main housing can provide support to a blower assembly, including a scroll and a blower wheel positioned within the scroll. A motor may be nestled within the scroll and coupled to the blower wheel. Electrical power can be supplied to the motor to cause the motor to rotate the blower wheel to generate a flow of fluid out of the fluid outlet.

17 Claims, 21 Drawing Sheets

(56) References Cited

U.S. PATENT DOCUMENTS

| | | | | | |
|---|---|---|---|---|---|
| 5,060,331 | A * | 10/1991 | Shie | B21K 1/708 | 470/23 |
| 6,045,176 | A * | 4/2000 | Shoup | B60J 7/226 | 454/219 |
| 6,261,175 | B1 | 7/2001 | Larson et al. | | |
| 6,979,169 | B2 * | 12/2005 | Penlesky et al. | 415/1 | |
| 7,677,770 | B2 * | 3/2010 | Mazzochette | F21S 8/026 | 362/294 |
| 7,896,570 | B2 * | 3/2011 | Gannon | F16B 2/12 | 361/679.37 |
| 8,840,653 | B2 * | 9/2014 | Thomke | A61B 17/60 | 24/335 |
| 9,689,581 | B2 * | 6/2017 | Zakula | F24F 7/065 | |
| 2006/0099903 | A1 * | 5/2006 | Bowler et al. | 454/121 | |
| 2012/0048647 | A1 * | 3/2012 | Green | E06C 1/16 | 182/111 |
| 2013/0130612 | A1 * | 5/2013 | Penlesky et al. | 454/237 | |
| 2015/0038070 | A1 * | 2/2015 | Zakula et al. | 454/347 | |

FOREIGN PATENT DOCUMENTS

| | | | |
|---|---|---|---|
| JP | 05-256489 | A | 10/1993 |
| JP | 6-50593 | Y2 * | 12/1994 |
| JP | 2000-046387 | A | 2/2000 |
| JP | 2004-132063 | A * | 4/2004 |
| JP | 2004219022 | A * | 8/2004 |
| JP | 2005-315552 | A | 11/2005 |
| JP | 2006105563 | A * | 4/2006 |
| JP | 2008-95883 | A * | 4/2008 |
| JP | 2009-063211 | A | 3/2009 |
| WO | WO-2014035649 | A1 | 3/2014 |

OTHER PUBLICATIONS

Gocho et al, JP 2000-046387 A English machine translation, Feb. 18, 2000.*

Unknown, JP 6-50593 Y2 English machine translation, Dec. 21, 1994.*

Shimizu, JP03023543U English translation, Mar. 12, 1991.*

Shimizu, JP2004-132063 A English machine translation, Apr. 30, 2004.*

KIPO Search Report and Written Opinion dated Oct. 18, 2013 for corresponding Application No. PCT/US2013/054531.

"International Application Serial No. PCT/US2013/054531, International Preliminary Report on Patentability dated Mar. 12, 2015", 9 pgs.

"Canadian Application Serial No. 2,883,087, Office Action dated Jun. 10, 2016", 3 pgs.

"Chinese Application Serial No. 201380054601.4, Office Action dated Aug. 31, 2016", (With English Translation), 14 pgs.

* cited by examiner

VENTILATION SYSTEM

BACKGROUND

Ventilating exhaust fans, such as those typically installed in bathrooms, draw air from within an area and pass the exhausted air out to another location, such as through a vent in the roof of a home or other structure. Many typical exhaust fans currently in use include a housing positioned within a building structure, such as in an aperture or other structure in a wall or ceiling.

Centrifugal exhaust fans typically include a main housing, a rotating fan wheel and motor assembly. The fan wheel can usually include a plurality of vanes that create an outward airflow during rotation, which, in turn, is directed out of an outlet opening. The fan wheel is typically coupled to a motor supported within the fan housing, and the motor drives the fan wheel, thus providing ventilation to an area. In order to meet performance demands, most modern ventilating exhaust fans are still relatively bulky, either due to the physical size of the motor, the fan wheel, or both.

SUMMARY

Some embodiments of the invention provide a ventilation exhaust fan comprising a main housing featuring a relatively compact size and low profile geometry. Some embodiments include a main housing, the main housing having a plurality of walls defining an interior space, at least one clamp aperture defined in at least one of the plurality of walls, and an aperture defining a ventilation orifice through which a fluid can be exhausted from the main housing. Some embodiments of the invention further include at least one spinner clamp, the spinner clamp comprising a clamping surface, wherein the at least one spinner clamp is coupled to the main housing, and configured and arranged to pivot with respect to the main housing to extend at least a portion of the clamping surface through the clamp aperture and outside of the main housing. Some embodiments include a blower assembly, the blower assembly comprising a motor substantially surrounded by a scroll, and a blower wheel coupled to the motor and substantially enclosed by the scroll, the scroll being in fluid communication with the ventilation orifice.

Some further embodiments of the invention provide a ventilation exhaust fan comprising a main housing featuring spinner clamps. In some embodiments, a plurality of spinner clamps is provided for anchoring the ventilation assembly to one or more structures in a building. In some embodiments, the spinner clamps comprise a clamping surface including a clamping surface perforation that can forcibly engage a surface. In some embodiments, the clamping surface perforation can pierce one or more surfaces to affix the ventilation assembly to a surface, and to prevent substantial vertical or lateral movement of the ventilation assembly once installed in a structure of a building.

In some embodiments, a duct connector assembly is provided. The duct connector assembly comprises a substantially oval cross-sectional geometry to complement the reduced dimension, low profile geometry of the main housing without compromising fluid flow efficiency. In some embodiments, the duct connector assembly also provides a damper flap that is coupled with a ventilation orifice. The duct connector assembly is capable of being moved within the ventilation orifice to substantially control the backflow of a fluid into the ventilation orifice. In some embodiments, a duct transition piece is provided. The duct transition piece can facilitate fluid coupling between the end of the duct connector assembly and a ventilation duct of a building.

DETAILED DESCRIPTION

Figure 1:
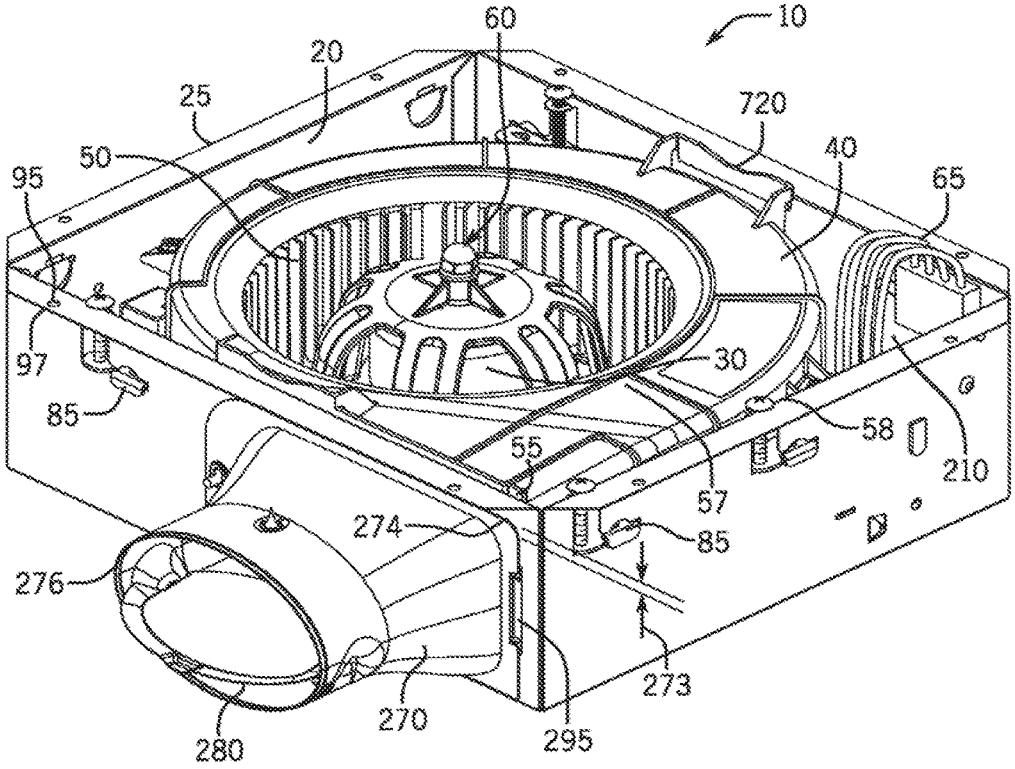
FIG. 1 is a perspective view of a ventilation assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIGS. 1, 2, 3, 4, 6, 7*a*, 7*b*, 8*a*, 11*a*, 17 and 20 illustrate a ventilation assembly 10 according to one embodiment of the invention. Some embodiments of the ventilation assembly 10 can include several components and devices that can perform various functions. In some embodiments, the ventilation assembly 10 can include a main housing 25, which can house the various components and devices of the ventilation assembly 10. In some embodiments, the dimensions of the main housing 25 enable the fully assembled ventilation assembly to be maneuvered and installed within a standard 2'×4' wall. In some embodiments, the ventilation assembly 10 generally can include a blower assembly 20, substantially positioned within the main housing 25. In some embodiments the blower assembly 20 generally can include a motor 30, a scroll 40 and a blower wheel 50 positioned substantially within the scroll 40 and mechanically coupled to the motor 30.

In some embodiments, the ventilation assembly 10 can be secured within a wall, ceiling, or other building structure in a partially, or fully recessed position. In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the ventilation assembly 10 can be installed within an intermediate space, outside of the room, area or space, and coupled with one or more ventilation duct assemblies to provide ventilation to the room, area or space. In some other embodiments, the fluid may comprise air, or other gases, or vapor, such as water vapor. In some embodiments, the fluid may comprise a smoke, ash, or other particulate in addition to air or other gases.

Figure 2:
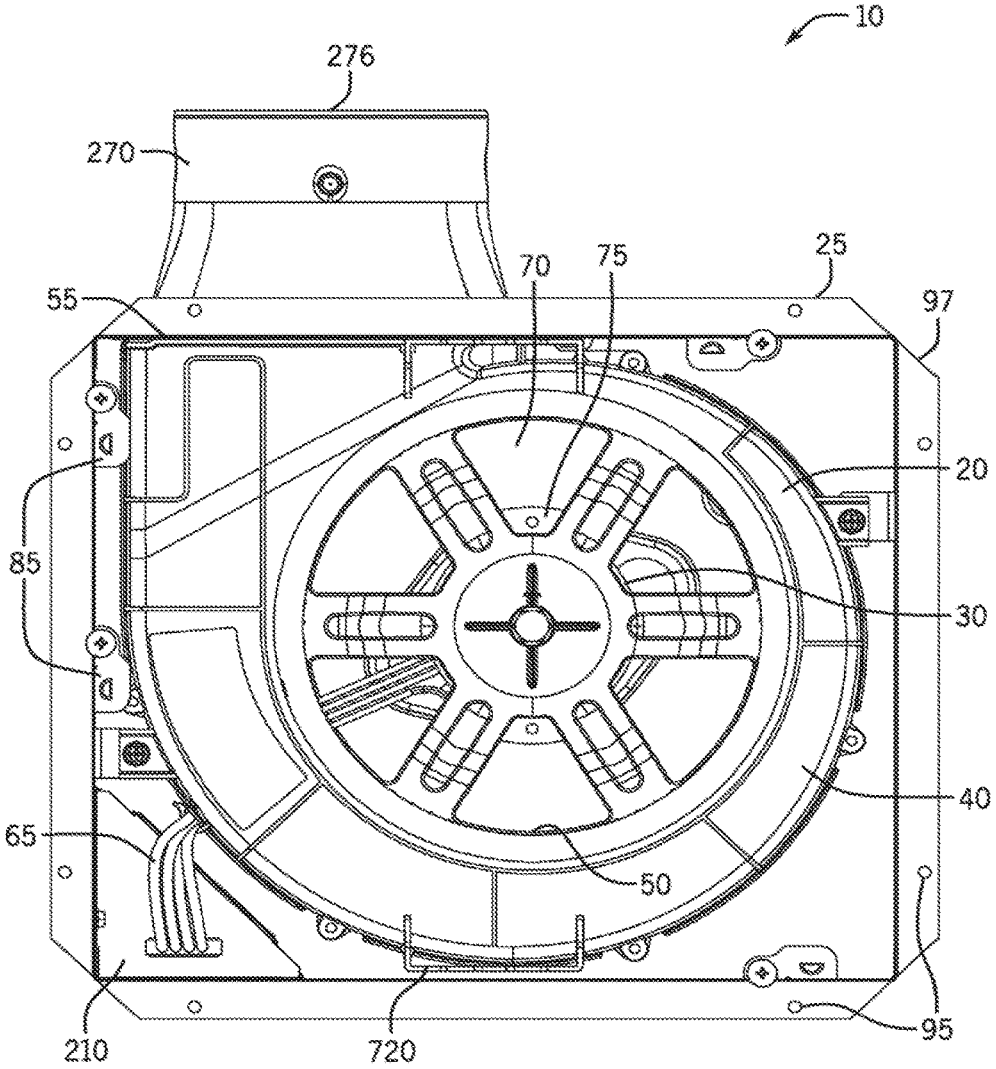
FIG. 2 is a top perspective view of a ventilation assembly according to one embodiment of the invention.
Figure 20:
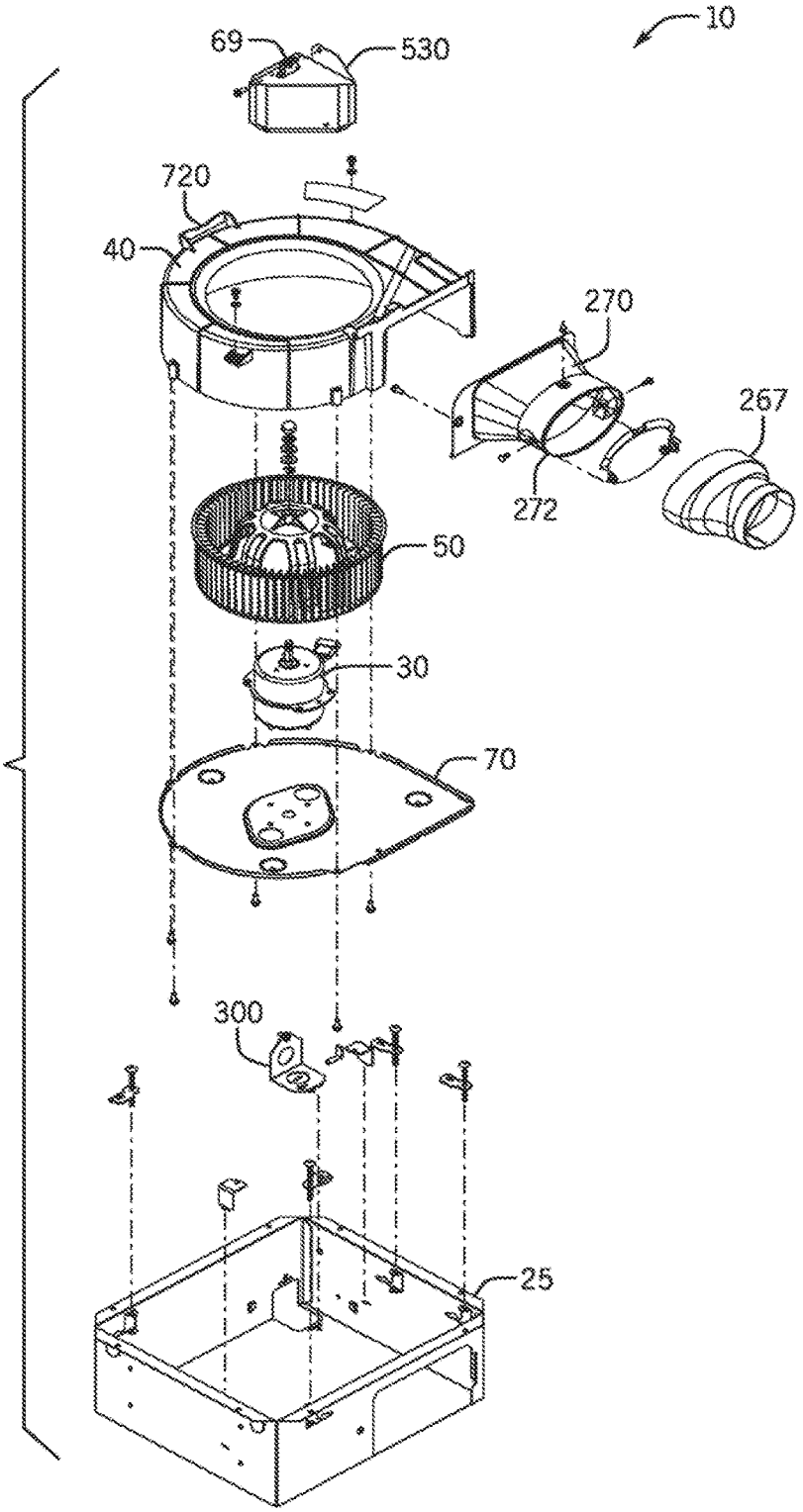
FIG. 20 is an exploded view of a ventilation assembly according to one embodiment of the invention.

As shown in the top perspective view of FIG. 1 and FIG. 2, and the exploded view of FIG. 20, in some embodiments of the invention, a blower assembly 20 can be provided as a compact assembly comprising a motor 30, motor mounting plate 70, nestled within a scroll 40, and coupled to a blower wheel 50. In some embodiments, the motor 30 can be mechanically secured to the motor mounting plate 70 using at least one motor plate bolt (75 in FIG. 2), and can be any motor capable of providing sufficient rotational torque to turn the blower wheel 50. In some embodiments the blower wheel 50 can be mechanically coupled to the motor using a main drive bolt, (see first end 60 of the main drive bolt in FIG. 1). In some embodiments, when a permanent split capacitor motor is used, the motor can be electrically coupled to at least one permanent split capacitor (not shown). In some embodiments, the motor 30 is electrically coupled to a motor power harness 65.

Figure 3:
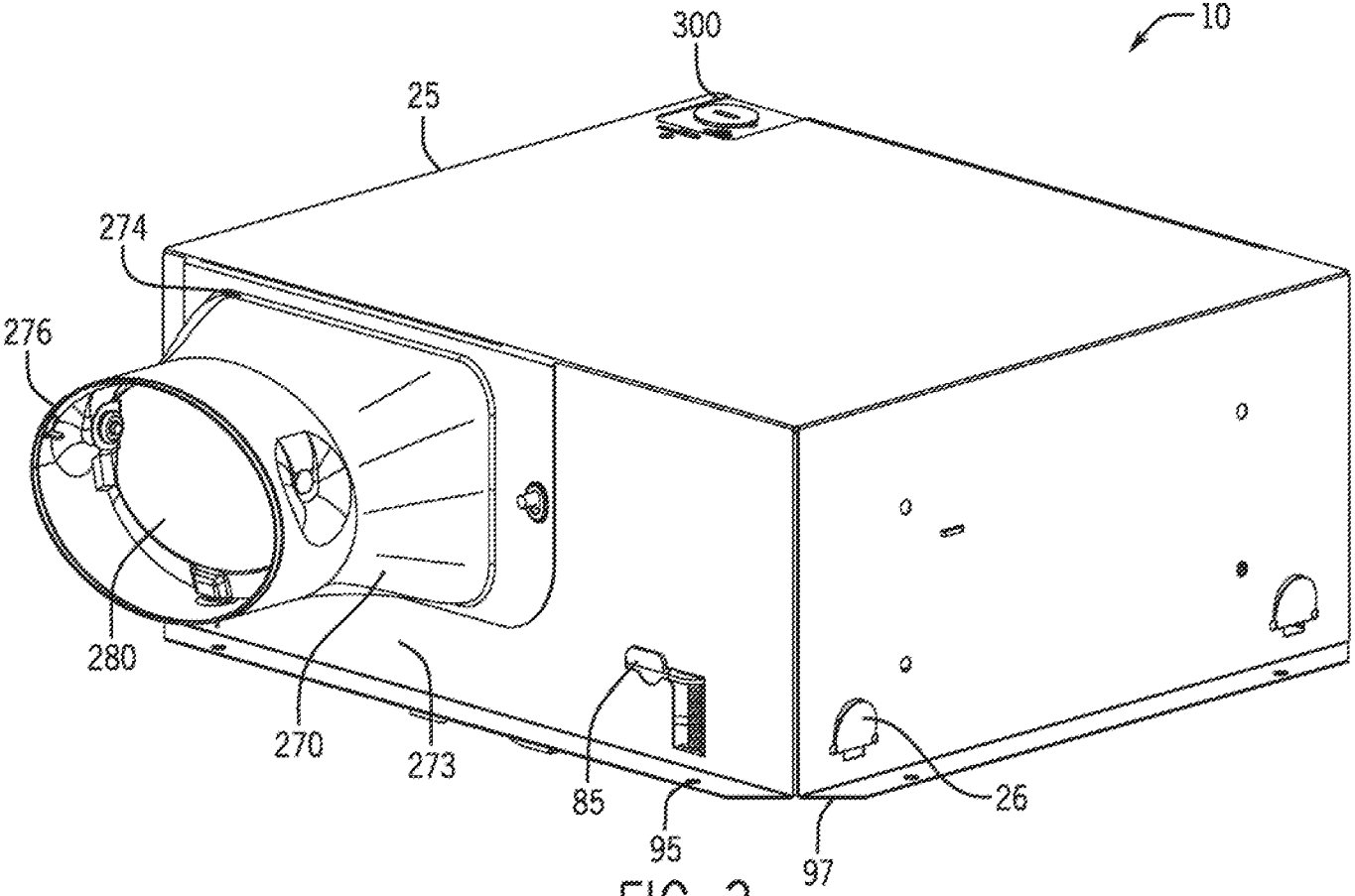
FIG. 3 is a perspective bottom view of a ventilation assembly according to one embodiment of the invention.
Figure 10:
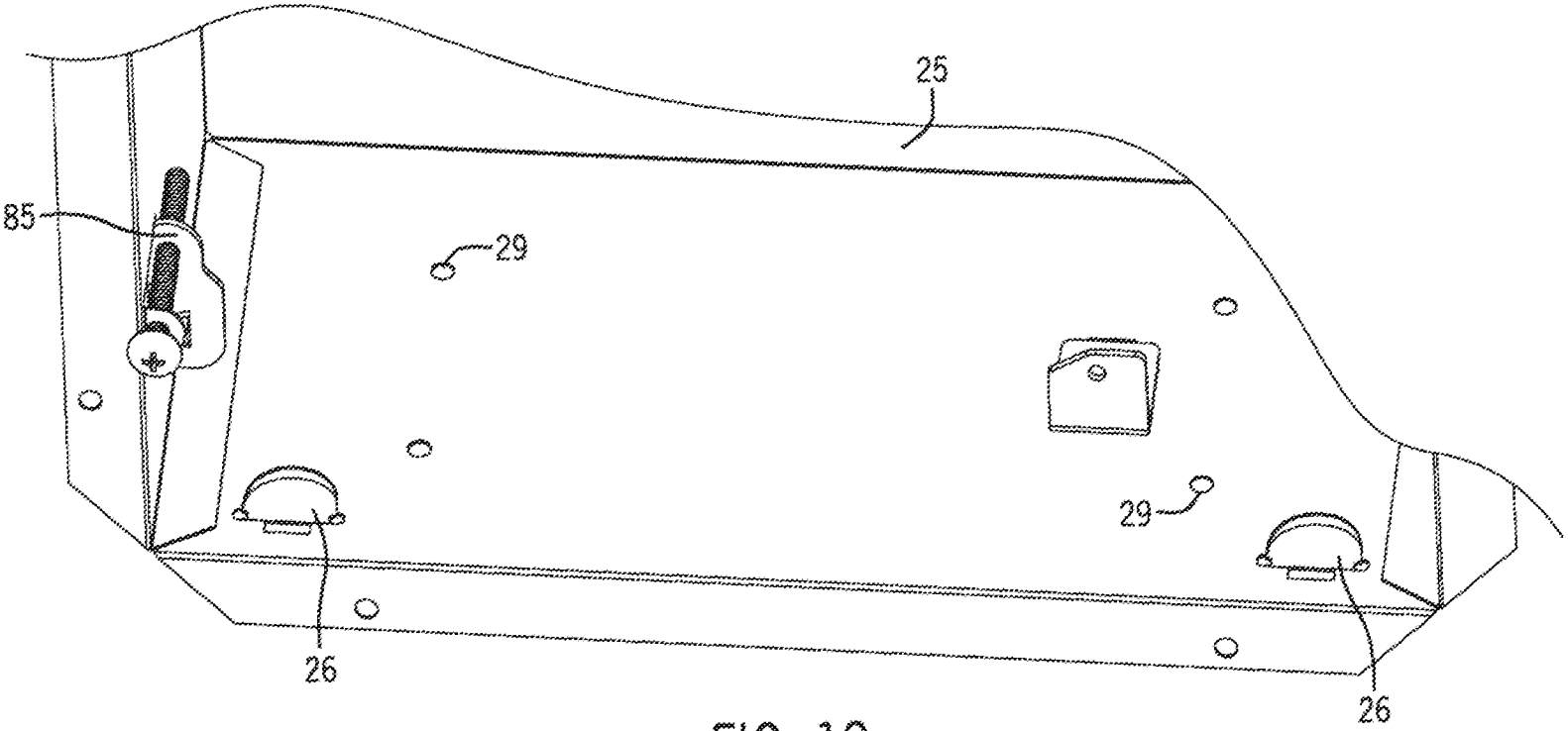
FIG. 10 is a view of the main housing according to one embodiment of the invention.
Figure 11A:
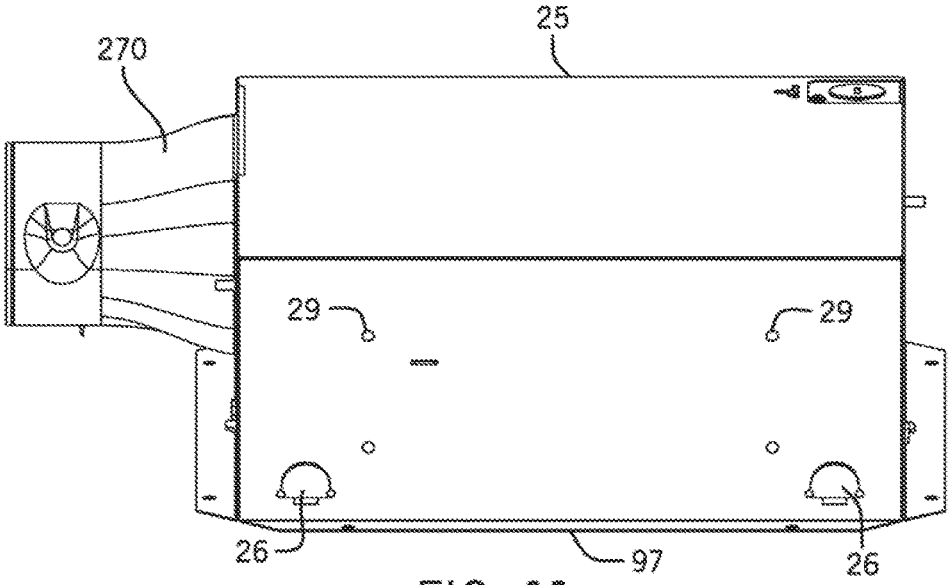
FIG. 11*a* is a perspective view of the ventilation assembly according to one embodiment of the invention.

In some further embodiments of the invention, as shown in FIGS. 1, 2, and 3, the main housing 25 can include a flange 97, and a plurality of flange mounting holes 95. In some embodiments, the flange mounting holes may be used to secure the main housing 25 and the ventilation assembly 10 to a surface. In some other embodiments, the main housing 25 includes one or more spinner clamps 85. In some embodiments, one or more spinner clamps may be used to secure the main housing 25, and the ventilation assembly 10 to a surface. In some other embodiments, the main housing 25 and the ventilation assembly 10 may be secured to a surface using other means. For example, in some embodiments, the main housing 25 may include a plurality of mounting holes 29 (as shown in FIG. 10 and FIG. 11*a*). In some other embodiments, the main housing 25 may be secured to a surface using other generally known methods. In some other embodiments, a clamp assembly can translate out of the main housing 25 to secure the main housing 25 to a surface. In some other embodiments, a clamp assembly can translate or rotate on top of a portion of the main housing 25 to secure it to a surface.

Figure 4:
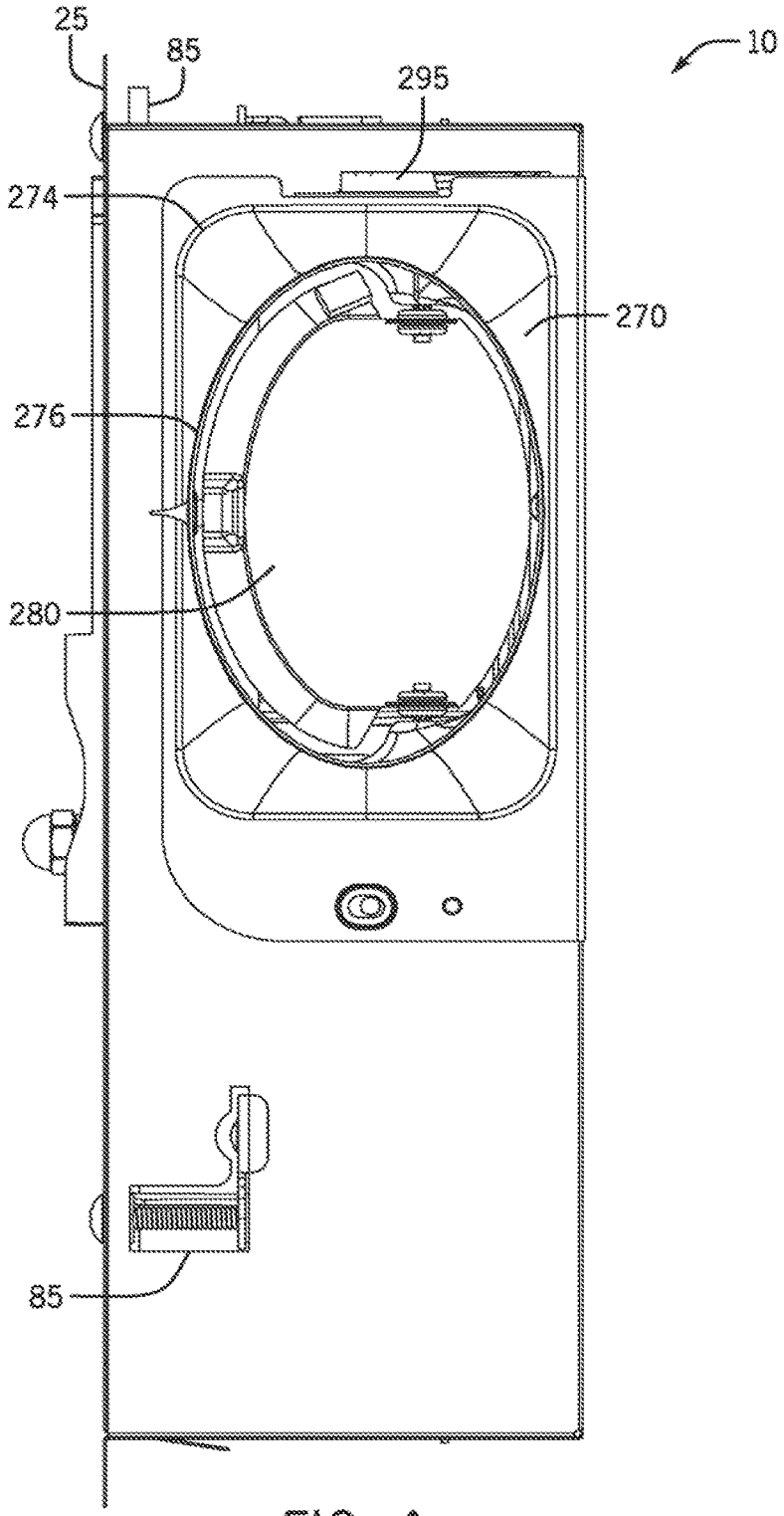
FIG. 4 is a side profile perspective view of a ventilation assembly according to one embodiment of the invention.

As mentioned previously, in some embodiments, the dimensions of the main housing 25 enable the fully assembled ventilation assembly to be maneuvered and installed within a standard 2'×4' wall. The compact nature of the blower assembly 20 enables the main housing 25 to achieve a low profile, as can be seen in FIG. 4. Furthermore, in some embodiments, a duct connector assembly 270 can be coupled to the ventilation assembly 10. In some embodiments, the duct connector assembly 270 comprises a substantially oval cross-sectional geometry to complement the reduced dimension, low profile geometry of the main housing 25 without compromising fluid flow efficiency. In some embodiments, the duct connector assembly 270 is positioned on the main housing 25 relative to the flange 97 so as to provide a spacing 273. In some embodiments, the spacing 273, formed between the duct connector assembly 270, and the flange 97 accommodates the use of different ceiling and wall material thicknesses.

Figure 17:
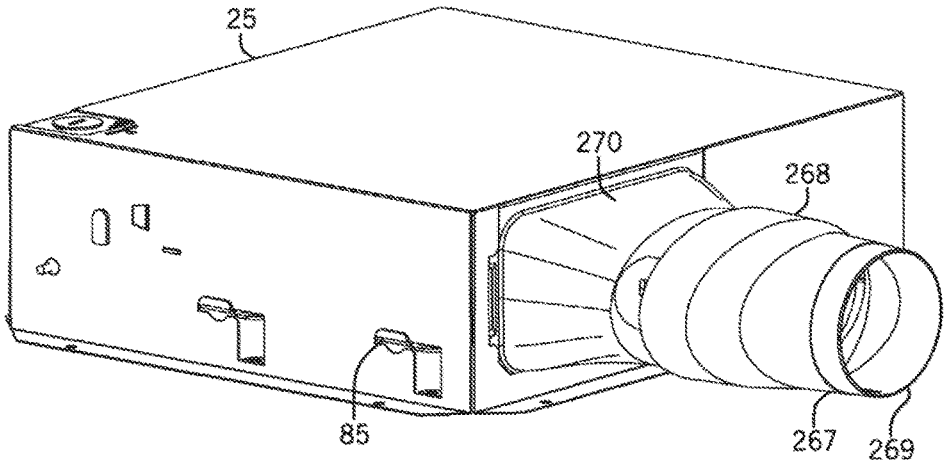
FIG. 17 is a perspective view of a duct transition piece installed on a duct connector assembly on a main housing according to one embodiment of the invention.

In some embodiments, the duct connector assembly 270 includes a first end 274 that interfaces with a ventilation orifice of the main housing 25, and a second end 276, capable of coupling directly with a ventilation duct of a building (not shown), or indirectly through the attachment of a duct transition piece 267 (shown in FIG. 17). In some embodiments of the invention, the duct connector assembly 270 includes a moveable damper flap 280 coupled with a ventilation orifice 272. In some embodiments the damper flap 280 can control the backflow of a fluid into a ventilation orifice 272 and the blower assembly 20, and further be capable of substantially controlling the flow of fluid from a space, such as a room, into the ventilation duct of a building, or structure, to an outside location. In some embodiments, the ventilation assembly 10 can be used to ventilate any room, area or space.

Figure 5B:
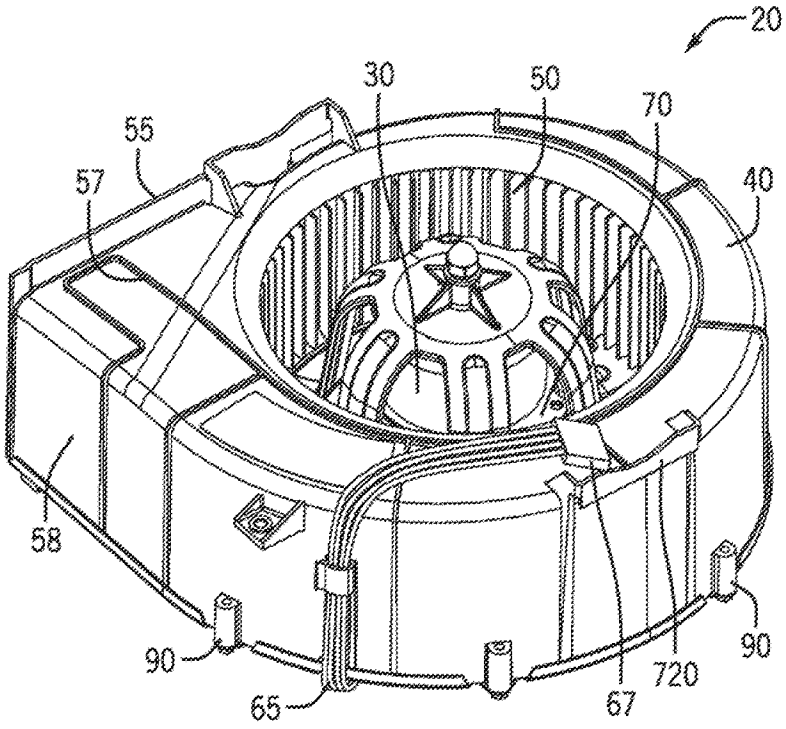
FIG. 5*b* is a top perspective view of a blower assembly according to one embodiment of the invention.
Figure 5A:
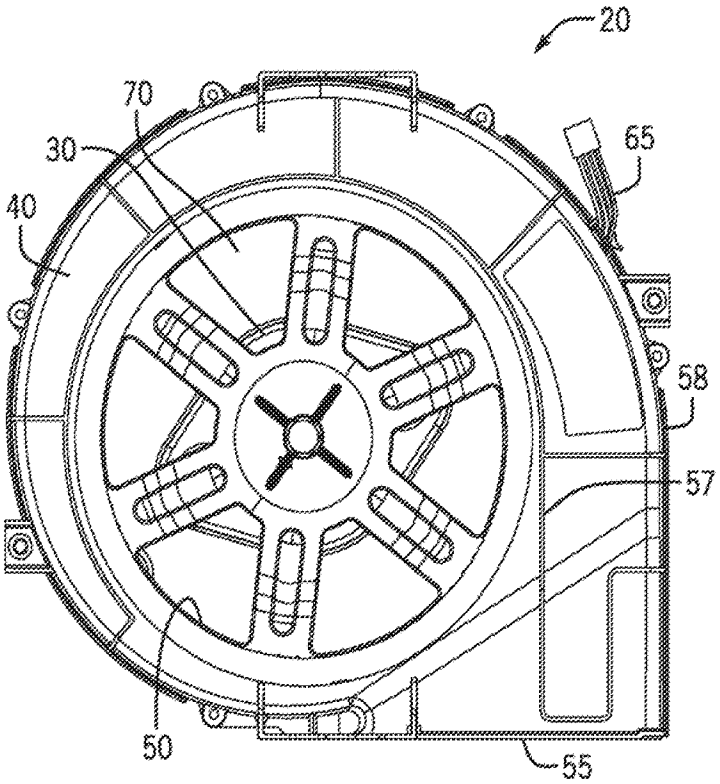
FIG. 5*a* is a top perspective view of a blower assembly according to one embodiment of the invention.

Referring now to FIG. 5*a* and FIG. 5*b* showing a top perspective view of the ventilation assembly 10, and showing a blower assembly 20 substantially housed within the main housing 25, it can be seen that the scroll can be formed into any shape, but generally is shaped to provide a compact and optimal fluid flow towards the blower outlet 55 when coupled to the motor mounting plate 70, and the rest of the blower assembly 20. As shown in FIG. 5*a* and FIG. 5*b*, the scroll can be sized in some embodiments to allow a large diameter centrifugal blower wheel. A large diameter centrifugal blower wheel provides a high ratio of cubic foot per minute ("cfm") of fluid flow to motor 30 revolutions per minute ("rpm"), thereby allowing the the motor to run quietly. The scroll may be formed from any material that is readily shaped, including, but not limited to, polymers, polymer-composites, metal, ceramic, or wood, or paper-based composite or laminate. Furthermore, the use of injection-molded or thermo-formed polymeric materials conveniently allows a variety of functional components to be included into the structure of the scroll 40. For example, in some embodiments, as shown in FIG. 2, the blower assembly 20 can include at least one horizontal rib 57, and at least one vertical rib 58. In some embodiments the scroll 40 includes a plurality of horizontal ribs 57, and a plurality vertical ribs 58. The ribs 57 and 58 provide added structural strength to the main housing 25 in both the vertical and horizontal planes. In some embodiments, the ribs 57 and 58 reinforce the scroll 40, preventing, or substantially reducing vibration. In some further embodiments, the scroll 40 includes a plurality of horizontal ribs 57 and vertical ribs 58 that substantially reduce low frequency noise from the blower assembly 20. In some other embodiments, the scroll 40 includes a plurality of horizontal ribs 57 and vertical ribs 58 that substantially reduce high frequency noise from the blower assembly 20. In some embodiments, other useful features may be integral with the scroll 40. For example, as shown in FIG. 5*b*, a screw boss 90 may be formed. In some other embodiments, more than one screw boss 90 may be formed. The screw boss 90 provides an anchoring feature for a fastener (not shown) to secure the scroll 40 to the motor mounting plate.

In some embodiments, a surface of the scroll 40 may provide an anchoring point for other components of the blower assembly 20. In some embodiments, one or more integral features of the scroll may provide an anchoring location for at least one component of the motor power harness 65. For example, referring to FIG. 5*b*, showing a side perspective view of a blower assembly 20 according to one embodiment of the invention, the motor power harness 65 may be secured with at least one feature integral to the scroll. Also shown in FIG. 5*b*, in some embodiments, the motor power harness, secured to the scroll 40 can include at least one plug 67. In some embodiments, as shown in FIG. 5*b*, holes may be integral to the scroll to provide a guide for at least one wire of the motor power harness 65. However in other embodiments, other methods may be used to secure the motor harness 65 to the scroll 40, such as clips, wire, wrap, or adhesive, or the like.

Figure 19:
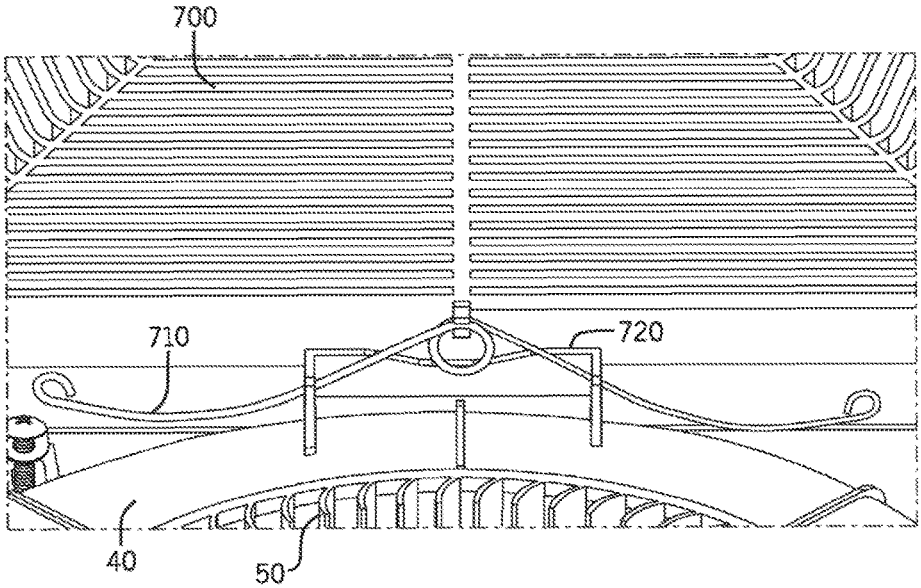
FIG. 19 is a close-up view of a duct connector assembly installed in a main housing according to one embodiment of the invention.

In some further embodiments of the invention, other useful features can be formed integral to the scroll 40. For example, as shown in FIGS. 1, 2, 5*b*, 6, 7*a*, and 7*b*, the scroll can include a grille spring holder 720. Referring to FIG. 19, in some embodiments, the grille spring holder 720 can be used with a grille spring 710 to conveniently secure a grille 700 to the ventilation assembly 10. In some embodiments, the scroll 40 can include a plurality of grille spring holders 720 to provide increased attachment capability to the grille 700. In some other embodiments, the grille 700 may be secured to the ventilation assembly 10 by some other component, such as a clip, a wire, a wrap, or adhesive, or the like. In some embodiments, the grille 700 can be formed from injection molded polymers, thermo-formed polymers, thermosetting polymers, or sheet metal, or any other suitable material.

Figure 6:
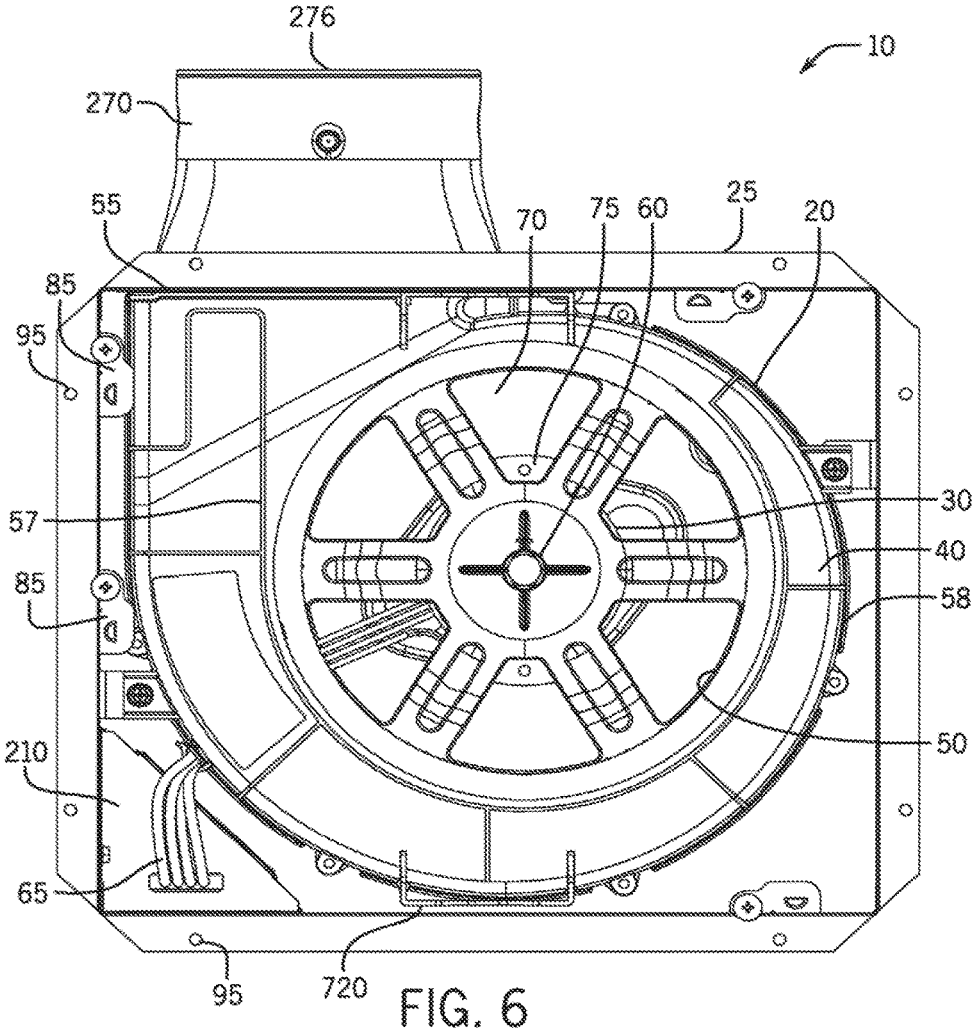
FIG. 6 is a top perspective view of a ventilation assembly according to one embodiment of the invention.
Figure 7B:
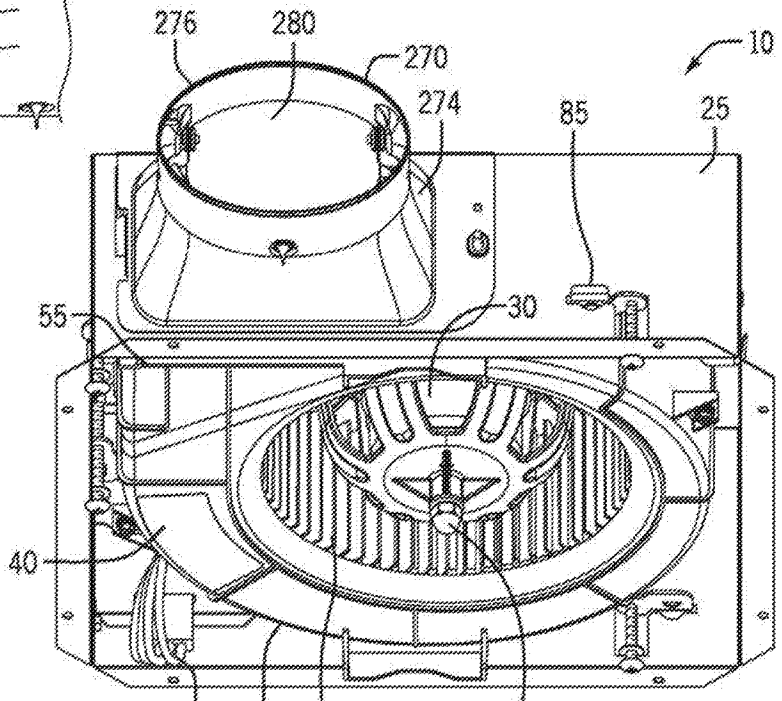
FIG. 7*b* is a duct connector side perspective view of a ventilation assembly according to one embodiment of the invention.
Figure 7A:
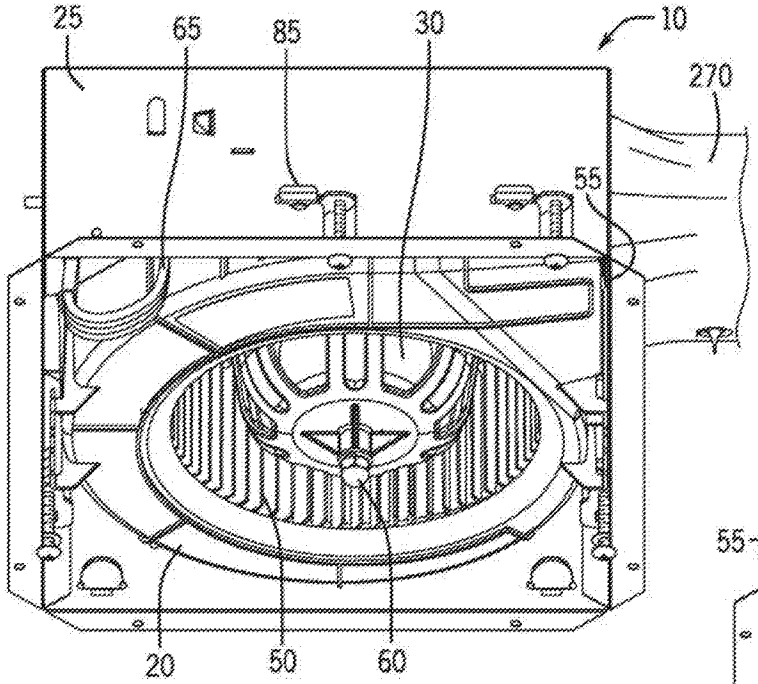
FIG. 7*a* is a side perspective view of a ventilation assembly according to one embodiment of the invention.
Figure 8A:
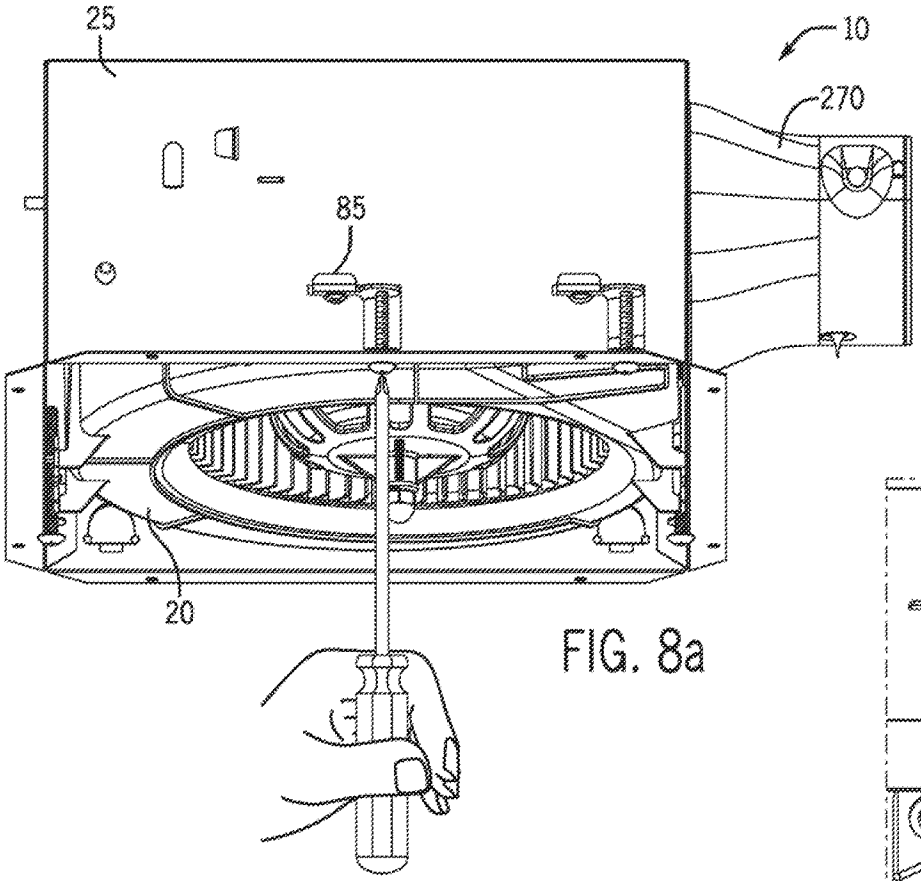
FIG. 8*a* is a side perspective view of a ventilation assembly with spinner clamps according to one embodiment of the invention.
Figure 8B:
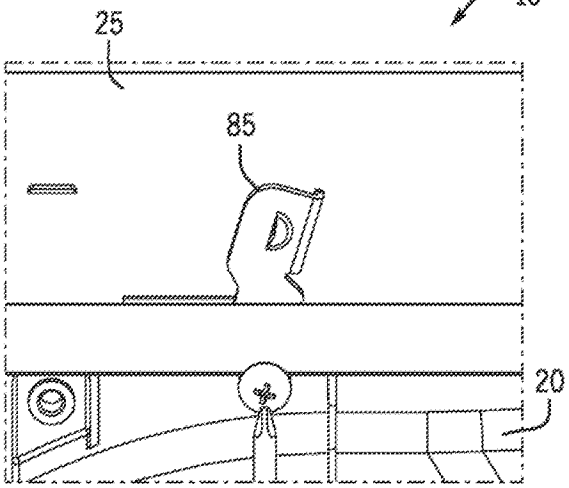
FIG. 8*b* is a close-up view of a spinner clamp in a ventilation assembly according to one embodiment of the invention.
Figure 9B:
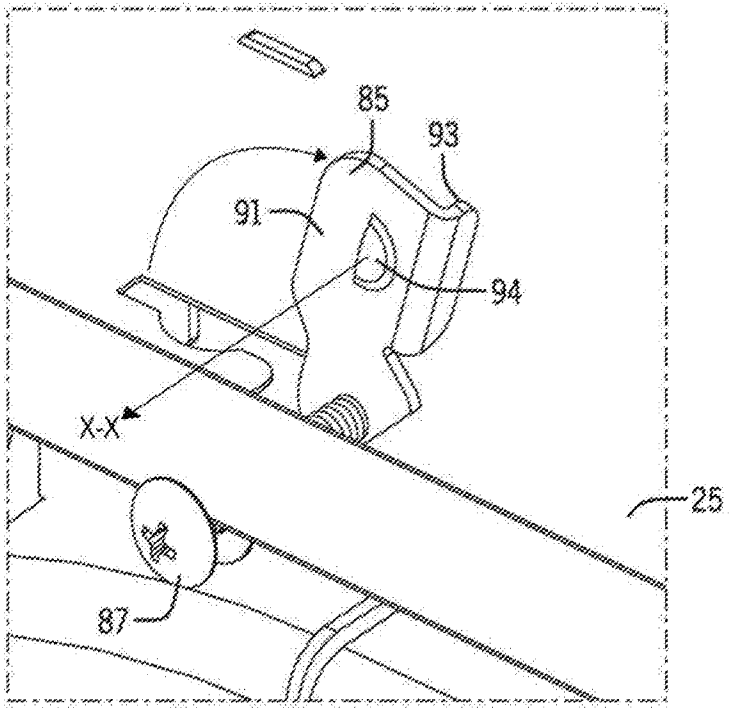
FIG. 9*b* is a close-up view of a spinner clamp in a ventilation assembly according to one embodiment of the invention.
Figure 9A:
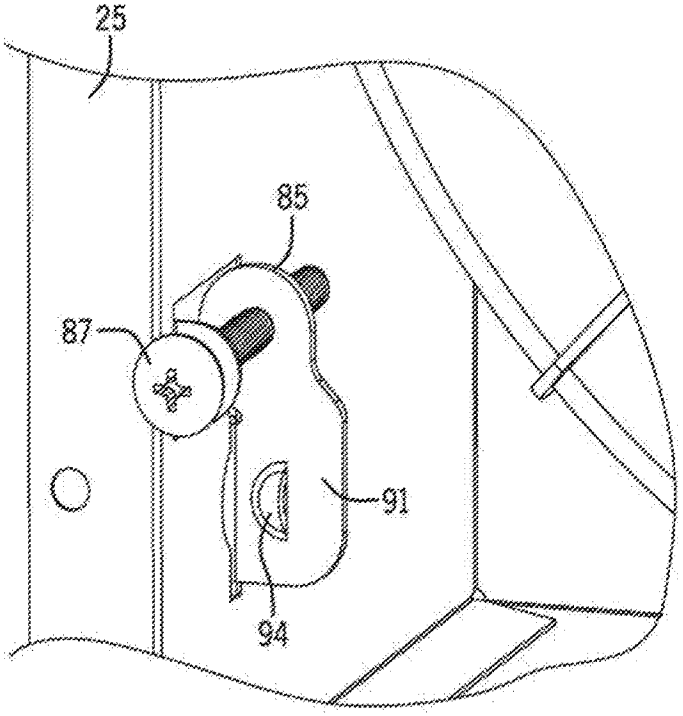
FIG. 9*a* is a close-up view of a spinner clamp in a ventilation assembly according to one embodiment of the invention.

As discussed earlier, one or more of the embodiments of the blower assembly 20 as shown in FIG. 1-4 may be coupled with a main housing 25 to form a ventilation assembly 10. In some embodiments, the main housing 25 may be formed into any shape, included but limited to, a rectangular box-like shape, an oval shape, a hemispherical shape, a spherical shape, a pyramidal shape, or any other shape. In some embodiments the main housing is formed from a sheet metal, including, but not limited to an aluminum-based metal, a steel or iron-based metal, a zinc-based metal, or a nickel and tin-based metal. In some other embodiments, the main housing 25 may be formed from injection molded polymers, thermo-formed polymers, thermosetting polymers, or sheet metal, or any other suitable material. In some other embodiments, the housing may comprises a wood-based product, such as wood, or particleboard or wood laminate. In some embodiments, the main housing 25 can form a base or a similar support structure of the ventilation assembly 10. Furthermore, in some embodiments, the main housing 25 can provide points and areas of attachment for the blower assembly, or other components of the assembly 10. For example, in some embodiments, the ventilation assembly 10 can include a duct connector assembly 270, comprising a first end 274 coupled with the main housing 25, and the blower outlet 55 (not shown), and a second end 276, forming a ventilation orifice 272. In some embodiments, the duct connector assembly 270 is pre-installed in a building structure and the duct connector assembly is coupled with a ventilation duct of a building with the second end 276 of the duct connector assembly 270. In some embodiments, the main housing 25 is firstly installed in an existing cavity or aperture of a structure such as a wall or ceiling. Subsequently the duct connector assembly 270 is installed by connecting a second end 276 with a ventilation duct of a building, and a first end 274 with an aperture in the main housing 25 (not shown). Installation is completed by securing a blower assembly 20 substantially in the main housing, and positioning the blower outlet 55 adjacent to the first end 274 of the duct connector assembly 270 installed adjacent to an aperture of the main housing 25. As shown in FIGS. 6, 7*a*, 7*b*, 8*a*, 8*b*, 9*a*, and 9*b*, in some other embodiments, the main housing 25 includes one or more spinner clamps 85. In some embodiments, one or more spinner clamps 85 may be used to secure the main housing 25, and the ventilation assembly 10 to a surface. In some other embodiments, the main housing 25, and the ventilation assembly 10 may be secured to a surface using other means, (for example, as discussed earlier, the main housing 25 may include a plurality of mounting holes 29 (as shown in FIG. 10 and FIG. 11*a*)). As shown in FIG. 6, a top perspective view of a ventilation assembly according to one embodiment of the invention, a plurality of spinner clamps 85 may be integral with the main housing 25. As shown in FIG. 7*b*, in some other embodiments, one or more spinner clamps may reside on the duct connector assembly 270 side of the main housing 25, or as shown in FIG. 7*a*, one or more spinner clamps 85 may reside on a side of the ventilation assembly 10 that is parallel with the duct connector assembly 270. Referring to FIG. 9*a* and FIG. 9*b*, in some embodiments, the spinner clamps comprise a clamping surface 91, a clamping surface form 93, and at least one clamping surface perforation 94. In some embodiments, the clamping surface perforation 94 can forcibly engage a surface. In some embodiments, the clamping surface perforation 94 can pierce one or more surfaces to affix the main housing 25 to a surface, and to prevent substantial vertical or lateral movement of the ventilation assembly 10 once installed in a structure of a building. For example, referring back to FIG. 8*a*, in some embodiments, the spinner clamps 85 may reside substantially flush with a side of the main housing. In this position, the clamping surface 91, clamping surface form 93, and the clamping surface perforation 94 or all inside the main housing 25.

In some embodiments, the clamping surface 91 provides a firm clamping force against a surface, allowing a ventilation assembly to be installed in a conventional, rectangular-shaped hole in a ceiling or wall. In some embodiments, the clamping surface form 93 stiffens the clamping surface 91. As shown in FIG. 8*a* and FIG. 8*b*, the spinner clamp 85 can further comprise a spinner clamp screw 87. In some embodiments, the spinner clamp screw 87 can be engaged by a screw-driver, or other tool. As shown in FIG. 8*a*, and FIG. 8*b*, the spinner clamp screw 87 can be engaged with a common screw-driver, and, as shown in FIGS. 8*b* and 9*b*, the spinner clamp 85 can be rotated clockwise within an extension plane, resulting in the positioning of the clamping surface 91, clamping surface form 93, and the clamping surface perforation 94 outside of the main housing 25. In some embodiments, the spinner clamp screw 87 can be further turned to move the spinner claim 85 along a tightening axis x-x, wherein the tightening axis x-x is transverse of the extension plane. In some embodiments, when the ventilation assembly is installed in a building, the clamping surface perforation 94 can forcibly engage a surface when the spinner clamp 85 is rotated in this manner. In some other embodiments, the clamping surface perforation 94 can pierce one or more surfaces during the installation process, resulting in a ventilation assembly 10 that is substantially restrained from vertical or lateral movement once installed in a structure of a building. In some embodiments, the dimensional and positional spacing of the spinner clamp 85 within the main housing 25 provides for a spacing of the clamping surface of a structure, (e.g. a ceiling or a wall) to be of a dimension to accommodate multiple different ceiling and wall thicknesses (not shown).

Figure 11B:
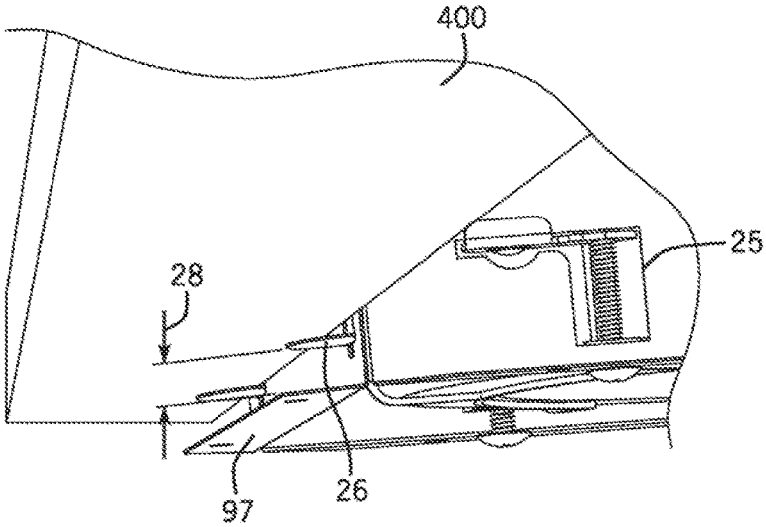
FIG. 11*b* is a close-up view of ventilation assembly as installed against a surface according to one embodiment of the invention.
Figure 12C:
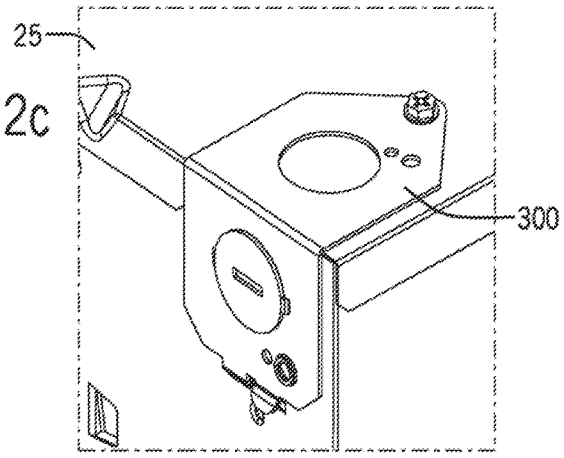
FIG. 12*c* is a close-up view of a knock-out panel in a main housing according to one embodiment of the invention.
Figure 12D:
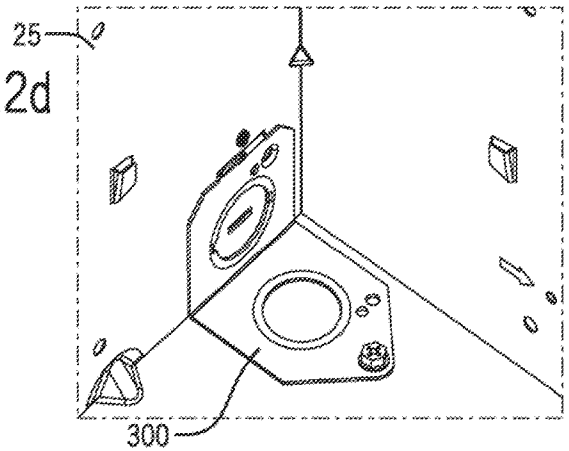
FIG. 12*d* is a close-up view of a knock-out panel in a main housing according to one embodiment of the invention.
Figure 12A:
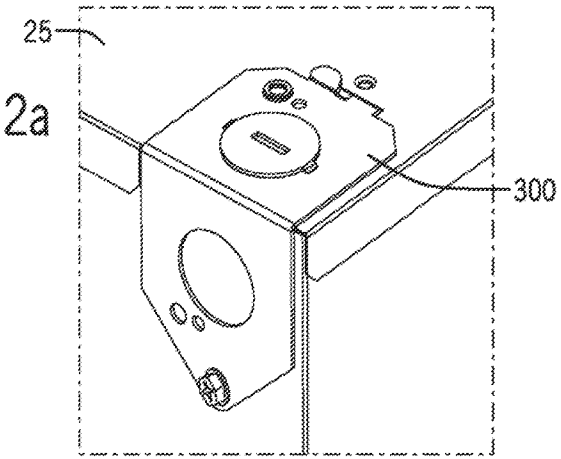
FIG. 12*a* is a close-up view of a knock-out panel in a main housing according to one embodiment of the invention.
Figure 12B:
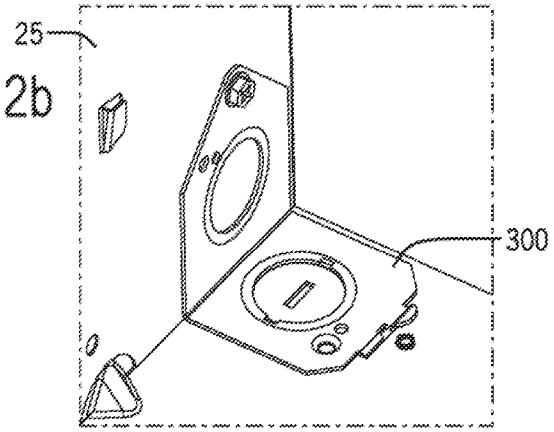
FIG. 12*b* is a close-up view of a knock-out panel in a main housing according to one embodiment of the invention.

As mentioned previously, in some embodiments, the dimensions of the main housing 25 enable the fully assembled ventilation assembly to be maneuvered and installed within a standard 2'×4' wall. The compact nature of the blower assembly 20 enables the main housing 25 to achieve a low profile, as can be seen in FIG. 4. In some other embodiments, the main housing 25 includes one or more spinner clamps 85. In some embodiments, one or more spinner clamps may be used to secure the main housing 25, and the ventilation assembly 10 to a surface. In some other embodiments, the main housing 25, and the ventilation assembly 10 may be secured to a surface using other means. For example, in some embodiments, the main housing 25 may include a plurality of mounting holes 29 (as shown in FIG. 10 and FIG. 11*a*). Furthermore, as show in FIG. 10, the main housing can include at least one vertical locating tab 26. In some embodiments, one or more vertical locating tabs 26 allows an installer to position the main housing 25 and the ventilation assembly 10 in a proper vertical location and orientation. In some embodiments, one or more vertical locating tabs 26 allows an installer to position the main housing 25 and the ventilation assembly 10 in a proper vertical location and orientation when mounting the main housing 25 against a 0.5" thick ceiling or wall material 400. Referring now to FIG. 11*a*, two vertical locating tabs 26 can be seen on one side of a ventilation assembly 10. FIG. 11*b* is a close-up view of ventilation assembly as installed against a surface according to one embodiment of the invention. A vertical locating tab 26 can be viewed providing positioning support for a ventilation assembly 10. Screws can be driven through one or more of the plurality of mounting holes 29, while the vertical locating tab 26 provides positioning support for a ventilation assembly 10, and a vertical tab spacing 28 is maintained.

Figure 13:
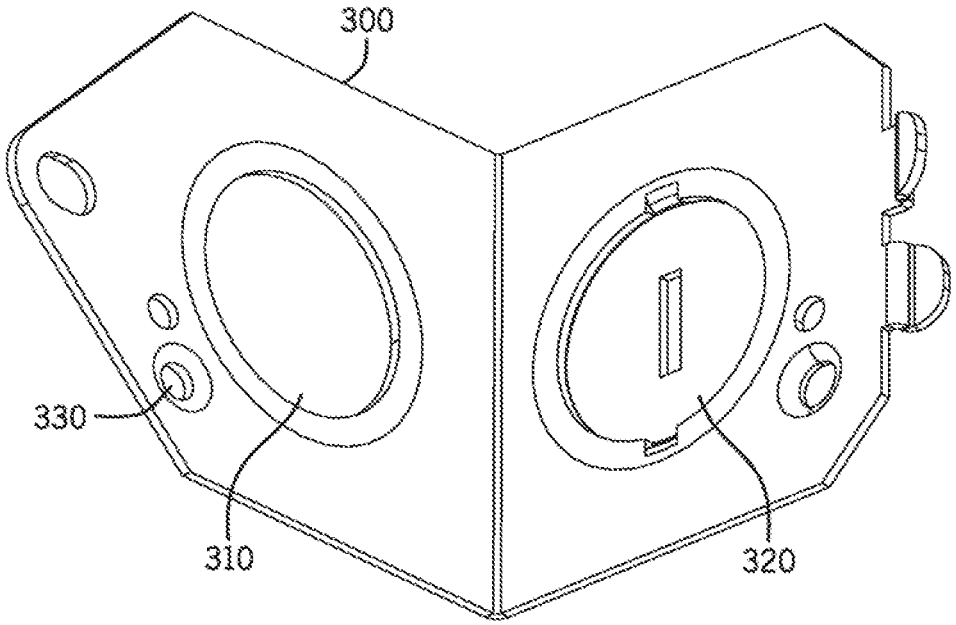
FIG. 13 is a close-up view of a knock-out panel according to one embodiment of the invention.
Figure 14A:
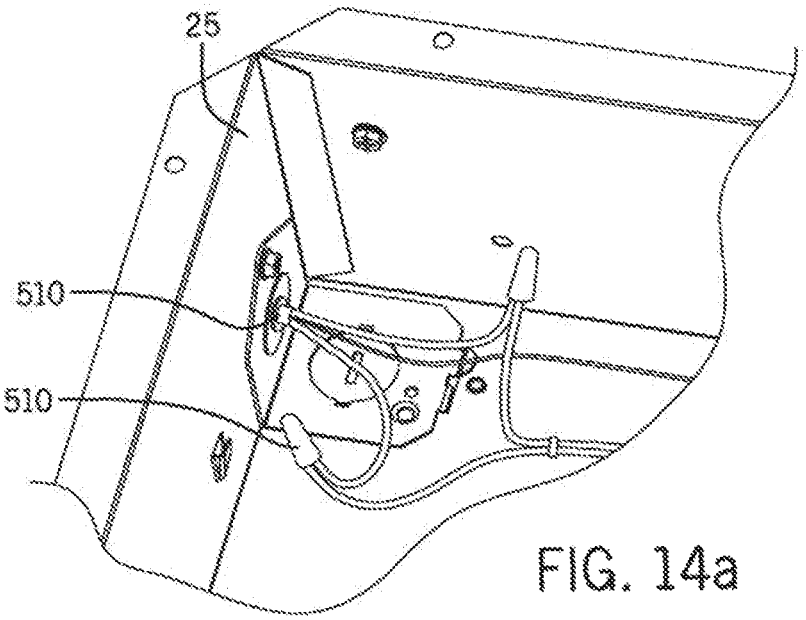
FIG. 14*a* is a close-up view of a field wiring input connector in a main housing according to one embodiment of the invention.
Figure 14B:
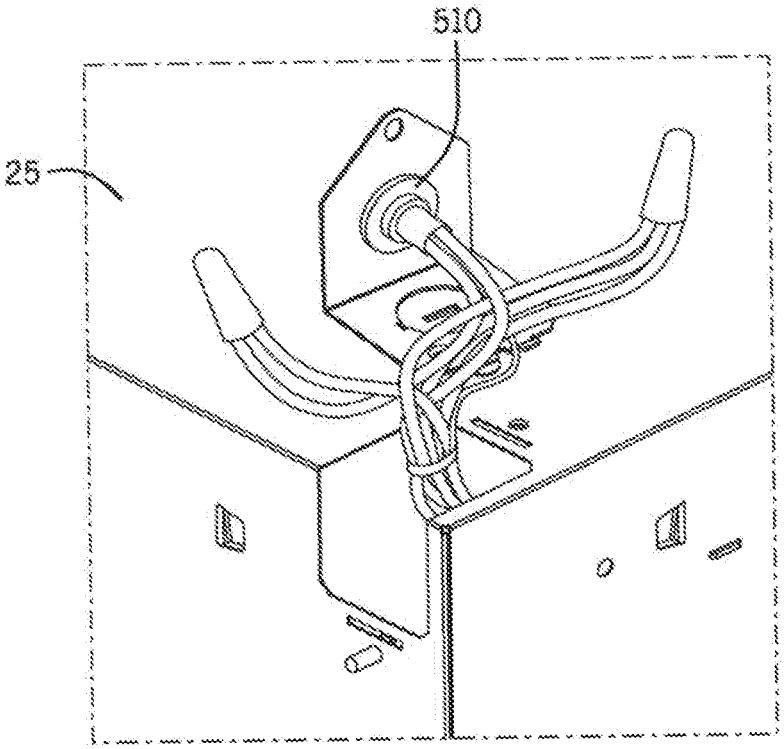
FIG. 14*b* is a close-up view of a field wiring input connector in a knock-out panel according to one embodiment of the invention.
Figure 14C:
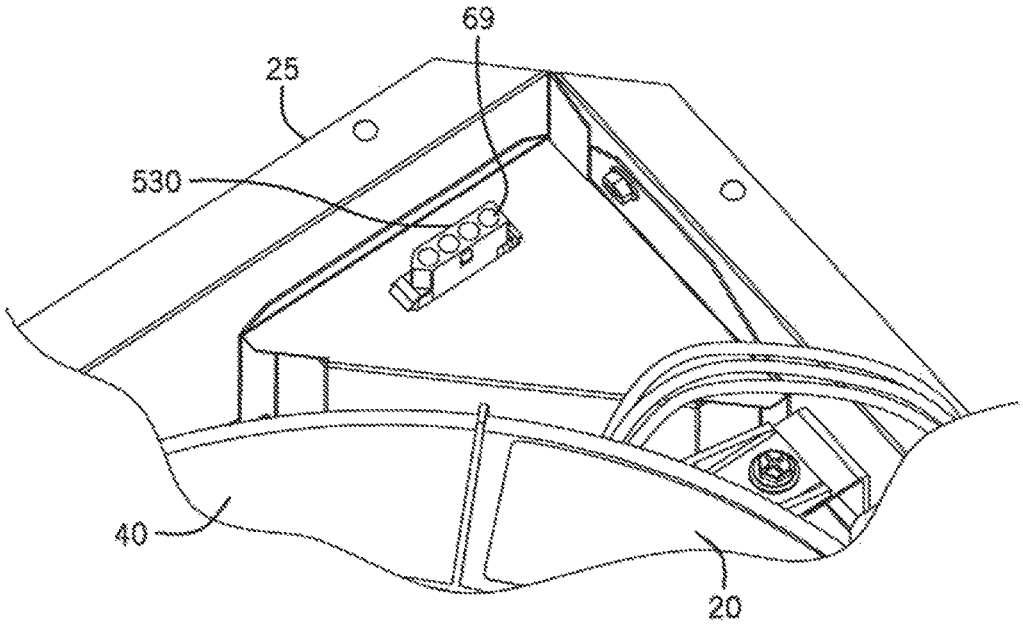
FIG. 14*c* is a close-up view of a motor plug receptacle installed in a main housing according one embodiment of the invention.
Figure 14D:
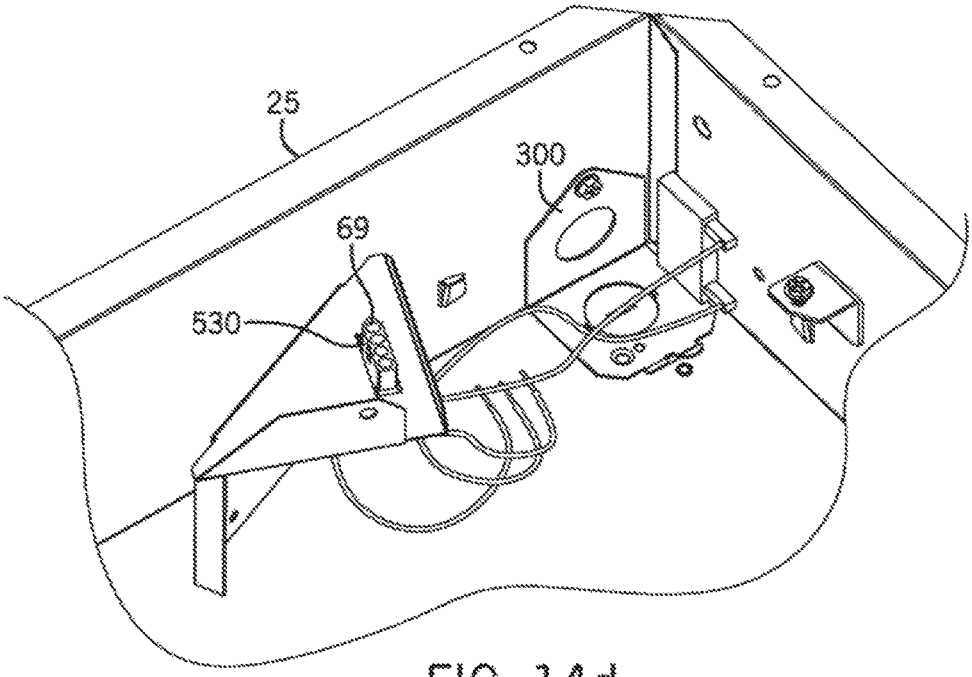
FIG. 14*d* is a close-up view of a field wiring input connector and a motor plug receptacle in a main housing according one embodiment of the invention.

In some further embodiments of the invention, other useful features can be formed integral with the main housing 25. For example, FIGS. 12*a*, 12*b*, 12*c*, and 12*d* show a close-up view of a knock-out panel 300 in a main housing 25 according to one embodiment of the invention. FIG. 13 shows a close-up view of a knock-out panel 300 according to one embodiment of the invention. In some embodiments of the invention, the knock-out panel 300 includes a first knock-out panel 310 and a second knock-out panel 320. In some embodiments the knock-out panel includes at least one ground screw hole 330. In some other embodiments, one or more apertures can be formed in areas of the main housing using one or more knock-out panels 300. These apertures can be used during the assembly and installation of the ventilation assembly 10 to gain access to critical components, and to provide pathways for one or more installed components or devices. In some embodiments, one or more knock-out panels 300 can be used to mount one or more components or devices. For example, as shown in FIG. 14*a* and FIG. 14*b*, a knock-out panel can provide support for at least one field wiring input connector 510. As shown in FIG. 14*c* and FIG. 14*d*, one or more knock-out panels 300 can provide support for a field wiring input connector 510, that is substantially covered and electrically coupled with a field wiring removal tab 530. In some embodiments, the knock-out panels 300 providing support for a field wiring input connector 510, and can be assembled and accessed from within the main housing 25, or from the outside, (as shown in FIG. 14*a* and FIG. 14*b*). In some embodiments, the field wiring removal tab 530 can be easily removed to provide access to the knock-out panel 300 providing support for a field wiring input connector 510. In some embodiments, when the main housing 25 is installed, one or more knock-out panels 300 can provide support for a field wiring input connector 510, covered and electrically coupled with a field wiring removal tab 530. As shown in the top perspective view of FIG. 1 and FIG. 2, in some embodiments of the invention, a blower assembly 20 can be provided as a compact assembly comprising a motor 30, motor mounting plate 70, nestled within a scroll 40, and coupled to a blower wheel 50. In some embodiments, the motor 30 can be mechanically secured to the motor mounting plate 70 using at least one motor plate bolt (75 in FIG. 2), and can be any motor capable of providing sufficient rotational torque to turn the blower wheel 50. In some embodiments, when the knock-out panel 300 provides support for and includes field wiring input connector 510, and is covered and electrically coupled with a field wiring removal tab 530, and coupled with a motor plug receptacle 69 extending through a power housing 210, and electrical power is supplied to the motor plug receptacle 69, electrical power is provided to the motor 30, resulting in the motor 30 providing rotational torque of sufficient magnitude to turn the blower wheel 50.

Figure 15:
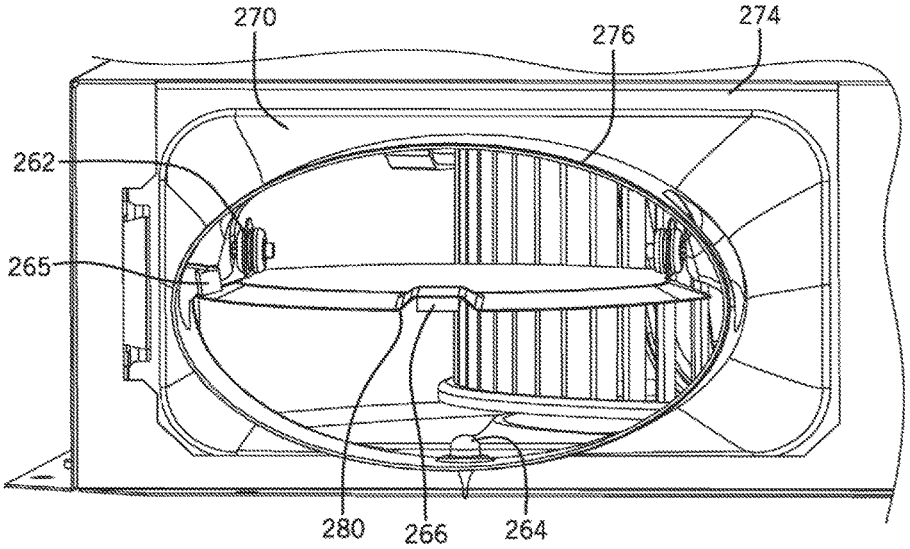
FIG. 15 is a close-up view of a duct connector assembly installed in a main housing according to one embodiment of the invention.

As described earlier, in some embodiments, the ventilation assembly 10 can be operable to discharge fluid flow from a space to another location. For example, as just discussed, in some embodiments, when power is provided to the blower assembly 20, a motor 30 can rotate a blower wheel 50 positioned substantially within a scroll 40. Fluid flow is moved substantially towards a ventilation orifice of the main housing 25. Furthermore, fluid flow can be substantially directed outside of the ventilation assembly 10 using at least one duct connector assembly 270. As discussed earlier, in some embodiments of the invention, the ventilation assembly 10 can include a duct connector assembly 270, comprising a first end 274 coupled with the main housing 25, and the blower outlet 55, and a second end 276, forming a ventilation orifice 272. In some embodiments, the main housing 25 is first installed in an existing cavity or aperture of a structure such as a wall or ceiling. Subsequently, the duct connector assembly 270 is installed by connecting a second end 276 with a ventilation duct of a building, and a first end 274 with an aperture in the main housing 25 (no shown). Installation is completed by securing a blower assembly 20 substantially in the main housing, positioning the blower outlet 55 adjacent to the first end 274 of the duct connector assembly 270 installed adjacent to an aperture of the main housing 25. In some embodiments, the duct connector assembly 270 is pre-installed in a building structure and not pre-installed in the main housing 25 of a ventilation assembly 10. As shown in FIG. 15, in some embodiments, the duct connector assembly 270 can comprise damper flap 280 that is rotatable within the duct connector assembly 270, and in some embodiments, can further include a damper open stop 262, and a damper closed stop 264, a damper open stop pad 265, and a damper close-stop pad 266. Following installation, the position of the damper flap 280 depends on the operational state of the blower assembly 20 (the motor 30 and the blower wheel 50), and the pressure differential between the space to be ventilated and the ventilation duct of the space, or some location fluidly connected with the ventilation assembly. In some embodiments, when the motor 30 is operating and the blower wheel 50 is rotating, the damper flap 280 can open to a fully open position (as shown in FIG. 15). To prevent the damper flap 280 from continual rotation within the duct connector assembly, the damper open stop 262 is integrated within the duct connector assembly 270. To prevent the damper flap 280 from causing excessive vibration and noise when the damper flap 280 reaches the damper open stop 262, a damper open stop pad 265 is integrated with the damper open stop 262. The damper open stop pad 265 may comprise a soft, mechanically compliant material such as rubber or foam to absorb the mechanical energy of the damper flap 280 as it impacts the damper open stop 262. In some embodiments, when the motor 30 is not operating and the blower wheel 50 is not rotating, the damper flap 280 may close (not shown). To prevent the damper flap 280 from continual rotation within the duct connector assembly, the damper close stop 264 is integrated within the duct connector assembly 270. To prevent the damper flap 280 from causing excessive vibration and noise when the damper flap 280 reaches the damper close stop 264, a damper close stop pad 266 is integrated with the damper close stop 264. The damper close stop pad 266 may comprise a soft, mechanically compliant material such as rubber or foam to absorb the mechanical energy of the damper flap 280 as it impacts the damper close stop 264. In some other embodiments, the damper flap 280 may open or close due to a pressure differential, and in those instances, when the damper flap 280 moves within the duct connector assembly, the damper close stop 264, the damper close stop pad 266, the damper open stop 262, and the damper open stop pad 265 provide the same functions as described.

Figure 16C:
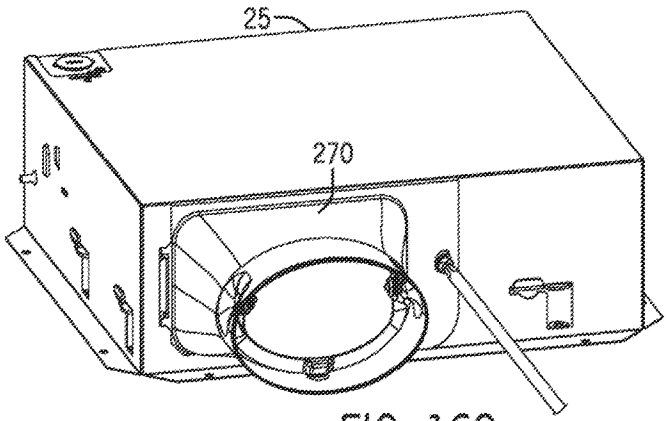
FIG. 16*c* is a perspective view of a duct connector assembly installed in a main housing according to one embodiment of the invention.
Figure 16D:
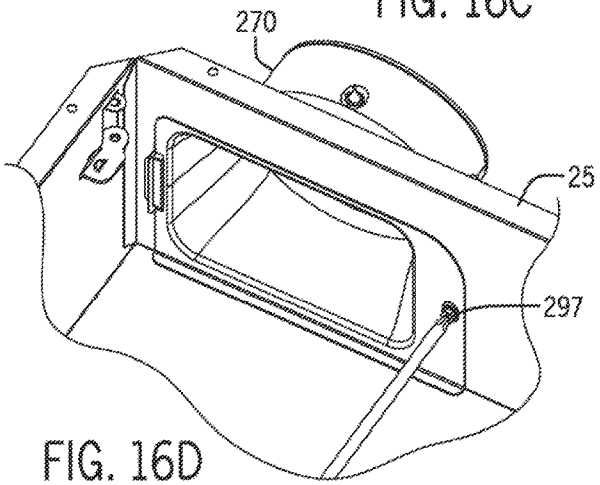
FIG. 16*d* is a view of a duct connector assembly installed in a main housing viewed from within the main housing according to one embodiment of the invention.
Figure 16A:
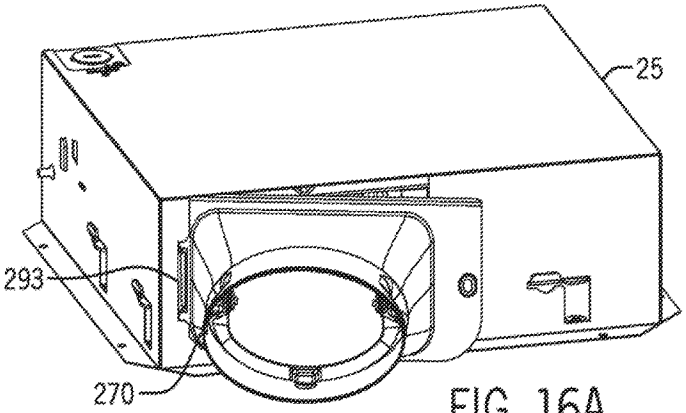
FIG. 16*a* is a perspective view of a duct connector assembly installed in a main housing according to one embodiment of the invention.
Figure 16B:
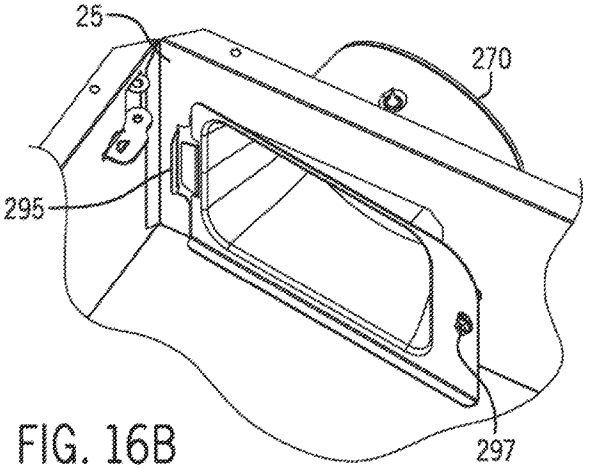
FIG. 16*b* is a view of a duct connector assembly installed in a main housing viewed from within the main housing according to one embodiment of the invention.

As discussed earlier, in some embodiments, the ventilation assembly 10 can be operable to discharge fluid flow from a space to another location. Fluid flow is moved substantially towards a ventilation orifice of the main housing 25. Furthermore, fluid flow can be substantially directed outside of the ventilation assembly 10 using at least one duct connector assembly 270. In some embodiments of the invention, the main housing can be pre-installed by inserting into a cavity or aperture of a structure. In some embodiments, as the assembly is installed, the installer can connect the second end 276 of a duct connector assembly 270 to the ventilation duct of a building or space, and then maneuver the main housing 25 into a cavity or space. In some other embodiments, the installer can connect the second end 276 of a duct connector assembly 270 to the ventilation duct of a building or space before installing the main housing 25. In those instances, once the duct connector assembly 270 is coupled with a ventilation duct of a building or space, the first end 274 of the duct connector assembly 270 is coupled with the main housing 25. In order to facilitate coupling in either scenario, some embodiments provide for a duct connector tab 295, a duct connector tab slot 293, and a duct connector assembly mounting screw 297. For example, as shown in FIGS. 16*a*, 16*b*, 16*c*, and 16*d*, the duct connector assembly can be mounted from the inside or the outside of the main housing 25, using the combination of the duct connector tab 295, a duct connector tab slot 293, and a duct connector assembly mounting screw 297 that can be accessed and secured from the outside (FIG. 16*c*) or the inside (FIG. 16*d*).

In some embodiments, the duct connector assembly 270 includes a first end 274 that interfaces with a ventilation orifice of the main housing 25, and a second end 276, capable of coupling directly with a ventilation duct of a building indirectly using a duct transition piece 267. The duct transition piece 267 facilitates fluid coupling between the second end of the duct connector assembly 270 and a ventilation duct of a building (not shown), and comprises a first end 268, designed to couple with the second end 276 of the duct connector assembly 270, and a second end 269, designed to couple with a ventilation duct of a building (not shown).

In some embodiments, the duct transition piece 267 comprises a hollow tube with a first end 268 comprising a substantially oval cross-section with a diameter of at least 4 inches in diameter and a second end 269 with a substantially circular cross-section with a diameter of at least 3 inches, and a substantially smoothly transitioning diameter from the first end 268 to the second end 269. Furthermore, in some embodiments of the invention, the ventilation assembly 10, including the duct connector assembly 270 with the duct transition piece 267 is further capable of substantially controlling the flow of fluid from a space into the ventilation of a duct of building when the motor is unpowered.

Figure 18B:
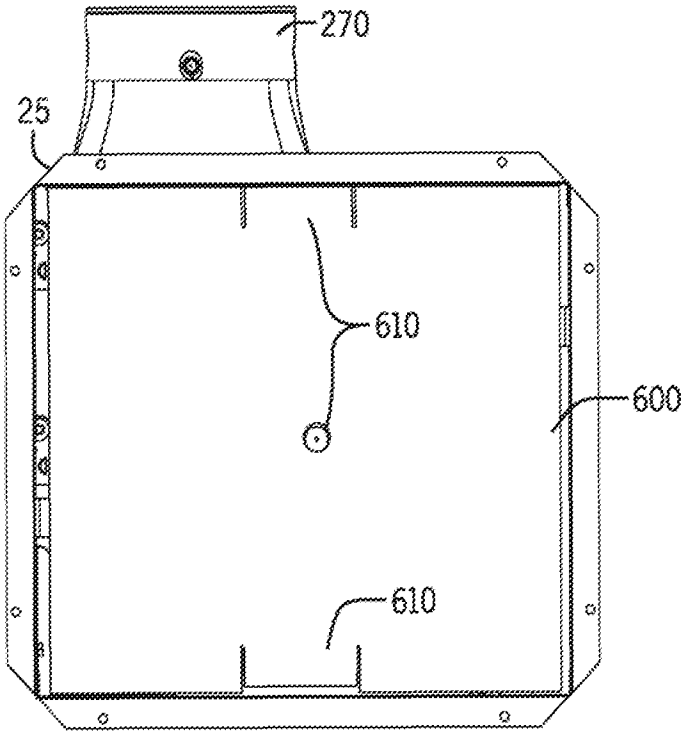
FIG. 18*b* is a perspective view of a plastic guard system installed in a ventilation system according to one embodiment of the invention.
Figure 18A:
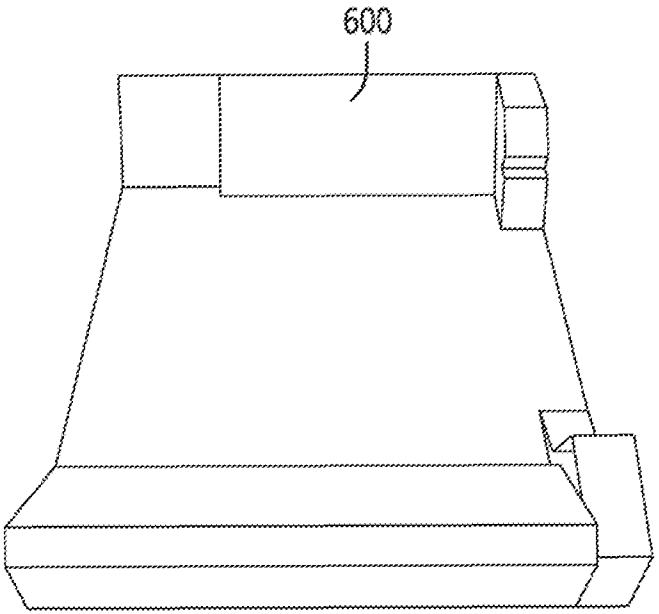
FIG. 18*a* is a perspective view of a plastic guard system

In some embodiments, the ventilation assembly 10 can be secured within a wall, ceiling, or other building structure in a partially, or fully recessed position. In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the ventilation assembly 10 can be installed within an intermediate space, outside of the room, area or space, and coupled with one or more ventilation duct assemblies to provide ventilation to the room, area or space. In most, if not all installation environments, the installation procedure can cause distribution of debris and other particulate matter. Furthermore, after a ventilation assembly 10 is installed, residual debris and other particulate matter can be substantially mobile in some circumstances. In some embodiments of the invention, to protect one or more components of the ventilation assembly 10, a plaster guard 600 can be secured to the ventilation main housing 25 using a plaster guard 610 fastening system. FIG. 18*a* is a perspective view of a plastic guard 600 system, and FIG. 18*b* is a perspective view of a plastic guard 600 system installed in a ventilation system 10 according to one embodiment of the invention. Furthermore, in some embodiments, the back (exterior) surface of the plaster guard 600 can include one or more instructions for assembly and installation.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A ventilation apparatus, comprising:

a main housing, the main housing having a plurality of walls defining an interior space, at least one clamp aperture defined in at least one of the plurality of walls, and an aperture defining a ventilation orifice through which a fluid can be exhausted from the main housing;

at least one spinner clamp comprising a clamping surface and a clamping surface form, the at least one spinner clamp being coupled to the main housing by an adjustment screw positioned within the interior space, wherein the adjustment screw is rotatable in a first direction to pivot the at least one spinner clamp within an extension plane with respect to the main housing from a retracted position into an extended position;

wherein the clamping surface is located inside the housing and the clamping surface form is located outside the housing when the spinner clamp is in the retracted position;

wherein the at least one spinner clamp extends at least a portion of the clamping surface through the clamp aperture and outside of the main housing in the extended position, wherein the clamping surface engages a portion of the at least one clamp aperture such that further rotation of the adjustment screw moves the at least one spinner clamp along a tightening axis transverse to the extension plane; and a blower assembly, the blower assembly comprising a motor substantially surrounded by a scroll, and a blower wheel coupled to the motor and substantially enclosed by the scroll, the scroll being in fluid communication with the ventilation orifice;

wherein the clamping surface form is configured to engage the main housing at the clamp aperture to limit rotation of the spinner clamp in a second direction past the retracted position, the second direction being opposite the first direction.

2. The ventilation apparatus of claim 1, wherein the motor does not extend past an inlet of the blower assembly.

3. The ventilation apparatus of claim 1, further comprising a duct connector assembly comprising a first end capable of being coupled with a ventilation orifice and a second end that includes a substantially oval portion.

4. The ventilation apparatus of claim 3, wherein the duct connector assembly further comprises a damper closed stop pad;

a damper open stop pad; and a damper flap, the damper flap capable of being moved within the duct connector assembly to substantially control the backflow of a fluid into the ventilation orifice.

5. The ventilation apparatus of claim 1, wherein the scroll includes at least one grille spring holder.

6. The ventilation apparatus of claim 5, further including a ventilation grill configured and arranged to be coupled to the scroll by the at least one grill spring holder.

7. The ventilation apparatus of claim 1, wherein the clamping surface includes a clamping surface perforation.

8. The ventilation apparatus of claim 1, wherein moving the clamping surface along the tightening axis after pivoting moves the clamping surface to a tighter clamping position.

9. The ventilation apparatus of claim 1, wherein the at least one clamp aperture having a first leg aligned with the extension plane and a second leg aligned with the tightening axis;

wherein the first leg and the second leg are arranged such that the at least clamp aperture is generally L-shaped.

10. The ventilation apparatus of claim 9, wherein the main housing adjacent the at least one clamp aperture adjacent the second leg engage the spinner clamp as the spinner clamp is moved along the tightening axis.

11. A ventilation apparatus, comprising:

a main housing, the main housing having a plurality of walls defining an interior space, at least one clamp aperture defined in at least one of the plurality of walls, and an aperture defining a ventilation orifice through which a fluid can be exhausted from the main housing;

at least one clamp comprising a clamping surface and a clamping surface form, the at least one clamp being coupled to the main housing by an adjustment screw positioned within the interior space, wherein the adjustment screw is rotatable in a first direction to pivot the clamp with respect to the main housing from a retracted position into an extended position;

wherein the clamping surface is located inside the housing and the clamping surface form is located outside the housing when the clamp is in the retracted position;

wherein the at least one clamp extends at least a portion of the clamping surface through the clamp aperture and outside of the main housing in the extended position, wherein the clamping surface is configured to engage a portion of the at least one clamp aperture such that further rotation of the adjustment screw in the first direction moves the at least one clamp along a tightening axis transverse to the extension plane; and a blower assembly, the blower assembly comprising a motor substantially surrounded by a scroll, and a blower wheel coupled to the motor and substantially enclosed by the scroll, the scroll being in fluid communication with the ventilation orifice, and wherein the motor does not extend past an inlet of the blower assembly;

wherein the clamping surface form is oriented to engage the main housing at the clamp aperture to limit rotation of the spinner clamp in a second direction past the retracted position, the second direction being opposite the first direction.

12. The ventilation apparatus of claim 11, wherein the blower wheel includes a hub that is configured and arranged to provide room for the motor to fit inside the blower wheel.

13. The ventilation apparatus of claim 11, further comprising a duct connector assembly comprising a first end capable of being coupled with a ventilation orifice and a second end that includes a substantially oval portion.

14. The ventilation apparatus of claim 11, wherein the scroll includes at least one grille spring holder.

15. The ventilation apparatus of claim 14, further including a ventilation grille configured and arranged to be coupled to the scroll by the at least one grille spring holder.

16. The ventilation apparatus of claim 11, wherein the at least clamp aperture having a first leg aligned with the extension plane and a second leg aligned with the tightening axis;

wherein the first leg and the second leg are arranged such that the at least clamp aperture is generally L-shaped.

17. The ventilation apparatus of claim 16, wherein the main housing adjacent the at least one clamp aperture adjacent the second leg engage the clamp as the clamp is moved along the tightening axis.

* * * * *